US007776201B1

(12) United States Patent
Vajo et al.

(10) Patent No.: US 7,776,201 B1
(45) Date of Patent: Aug. 17, 2010

(54) ELECTROCHEMICAL REGENERATION OF CHEMICAL HYDRIDES

(75) Inventors: John J. Vajo, West Hills, CA (US); Ping Liu, Thousand Oaks, CA (US)

(73) Assignee: HRL Laboratories, Malibu, CA (US)

( * ) Notice: Subject to any disclaimer, the term of this patent is extended or adjusted under 35 U.S.C. 154(b) by 1455 days.

(21) Appl. No.: 11/154,115

(22) Filed: Jun. 15, 2005

(51) Int. Cl.
*C25B 1/00* (2006.01)

(52) U.S. Cl. ..... 205/357; 205/358; 205/549

(58) Field of Classification Search ..... 205/549, 205/358, 357; 204/252, 265
See application file for complete search history.

(56) References Cited

U.S. PATENT DOCUMENTS 6,497,973 B1 * 12/2002 Amendola ..... 429/19
6,663,763 B2 * 12/2003 Strezov et al. ..... 205/367
7,108,777 B2 * 9/2006 Xu et al. ..... 205/408
2006/0102489 A1 * 5/2006 Kelly ..... 205/358

* cited by examiner

*Primary Examiner*—Arun S Phasge
(74) *Attorney, Agent, or Firm*—Christie, Parker, Hale

(57) ABSTRACT

A method for regenerating chemical hydrides from metal oxides and electrochemical cell for use in carrying out the method. The electrochemical cell has a cathode side with molten salt and a cathode, and an anode electrode side with an anode. The cathode side and the anode side are separated by an oxygen anion-conducting membrane. A metal oxide is placed in the molten salt of the cathode side and an electrical potential is applied to the cathode and anode while feeding hydrogen to the cathode electrode to effectuate conversion of the metal oxide to a metal hydride and feeding hydrogen to the anode to generate water and free electrons.

15 Claims, 2 Drawing Sheets

ELECTROCHEMICAL REGENERATION OF CHEMICAL HYDRIDES

BACKGROUND

The invention relates to the field of chemical hydrides, and more particularly to a method and device to regenerate chemical hydrides using molten salt-based electrochemical cells.

Hydrogen is a product of the reaction of metals and chemical compounds in water. The common chemistry lab experiment of floating a piece of Na on water to produce hydrogen gas demonstrates this principle, and the Na transforms to NaOH in this reaction. The reaction is not directly reversible, but NaOH can, for example, be removed and reduced in a solar furnace back to metallic Na. In this reaction, two Na atoms react with two $H_2O$ molecules to produce $H_2$. The hydrogen molecule produces a $H_2O$ molecule in combustion, which can be recycled to produce more $H_2$ gas. However, the second $H_2O$ molecule necessary for the oxidation of the two Na atoms must be added. Therefore, Na has a gravimetric hydrogen density of about 2.5 mass %. The same process carried out with Li leads to a gravimetric hydrogen density of about 4 mass %. Thus, while metal hydride storage technology is an option as a chemical storage means for hydrogen, the lack of efficient techniques for regenerating the chemical hydrides remains an impediment to developing this storage technology.

Simple chemical hydride systems such as the hydrolysis (the reaction with water) of LiH, NaH, or $MgH_2$, are currently recycled (from the LiOH, NaOH, or $Mg(OH)_2$ products) using carbo-thermic or hydro-thermic reduction. These recycling processes operate at high temperatures (1000° C.) and generate the pure metals (i.e., Li, Na, or Mg). For example, estimates of the energy input necessary to generate the metal Li by the conventional method for recycling are as follows. Chemical generation of Li metal from LiOH begins with dehydrogenation to $Li_2O$ according to the reaction $LiOH \rightarrow \frac{1}{2}Li_2O + \frac{1}{2}H_2O(g)$. The standard enthalpy for this reaction is 65 kJ/mol-LiOH. Two possible chemical reduction methods to generate Li metal from $Li_2O$ are $Li_2O + \frac{1}{2}C \rightarrow 2Li + \frac{1}{2}CO_2$ and $Li_2O + H_2 \rightarrow 2Li + H_2O(g)$. The standard enthalpy for the first reaction is 402 kJ/mol-$Li_2O$ and for the second is 357 kJ/mol-$Li_2O$. The low energy efficiency of these reactions is accordingly clear. In a second step, the pure metals are hydrogenated to the corresponding hydrides. Formation of the pure metals from the spent hydride material is an extremely energy intensive process, considerably more energy intensive than directly regenerating the hydrides. Thus, the energy-efficiency of the overall processes is low.

Complex chemical hydride systems, such as the hydrolysis of $LiBH_4$ or $NaBH_4$, or the hydride/hydroxide reaction between $LiBH_4$ and $LiOH.H_2O$, cannot be recycled easily by carbo-thermic or hydro-thermic reduction. To recycle $NaBH_4$ (from the hydrolysis product $NaBO_2$), reaction with $MgH_2$ has been developed. This reaction is exothermic (which wastes energy unless the exothermic heat is captured and utilized) and produces MgO. The MgO byproduct must subsequently be recycled back into $MgH_2$ in an energy intensive process. Again, the overall energy-efficiency is low.

Currently, a large obstacle to the widespread use of chemical hydrides for hydrogen generation is the low recycling efficiency. In any widespread application the spent (i.e., dehydrogenated) hydride must be recycled. Because chemical hydrides release hydrogen exothermically, recycling requires energy input (i.e., the hydrogenation reaction is endothermic). One way to input the required energy is to couple the endothermic hydrogenation reaction with at least one exothermic reaction. However, the methods thus far developed to do this operate at high temperatures, require multiple steps, and therefore, have poor overall efficiency. Another option is providing the energy electrochemically.

An electrochemical process has recently been described to recycle NaOH, the product of NaH hydrolysis. Although the overall energy-efficiency has not been evaluated, the process currently still first produces Na metal, and a second step is required to form NaH.

There accordingly remains a need for improved methodologies and devices to regenerate chemical hydrides, whether simple hydride systems or complex hydride systems.

SUMMARY

The invention is an electrochemical regeneration method and device that achieves high energy-efficiency by reforming chemical hydrides. In connection with the method, the invention provides an electrochemical cell design which uses an oxygen anion-conducting separator together with simultaneous reduction and oxidation of hydrogen to provide an energy efficient method for recycling chemical hydrides. With this design, regeneration of the chemical hydride is performed in either a single efficient step, or a single efficient step coupled with other efficient step(s). The use of single step regeneration, or a single efficient step coupled with other efficient step(s) optimizes the energy efficiency of the overall regeneration process.

The invention can be applied to both simple and complex hydride hydrolysis systems as well as to hydride/hydroxide systems. The required is energy input electrochemically and the recycled hydride can be formed without first producing the pure metal.

DETAILED DESCRIPTION OF THE INVENTION

This invention is a method and device for regenerating spent (i.e., dehydrogenated) chemical hydrides using electrochemical processing. As the term is used herein, chemical hydrides refer to materials that are often hydridic (that contain hydrogen atoms that have at least a partial negative charge) and that generate hydrogen by chemical reaction with a second material that is protonic (that contain hydrogen atoms that have at least a partial positive charge). Three examples of chemical hydrides are $LiH + H_2O$, $NaBH_4 + 2H_2O$, and LiH+LiOH, in which the hydrogen atoms in the first reactant in each combination are hydridic and the hydrogen atoms in the second reactant are protonic. More examples are noted below. Simple metals, for example Na, that generate hydrogen by reaction with protonic materials may also, somewhat loosely, be considered chemical hydrides. In many cases the reactions of chemical hydrides are exothermic or only slightly endothermic and, therefore, the byproducts of hydrogen generation (in the examples above the byproducts are LiOH, $NaBO_2$, and $Li_2O$, respectively) cannot be regenerated simply by supplying hydrogen. Additional chemical processing is necessary to overcome the loss of entropy during regeneration that accompanies incorporation of hydrogen into condensed phases.

The method of the invention regenerates the chemical hydride directly in a single efficient step, or a single step coupled with other efficient step(s), although separation and purification of the hydride products are necessary. The method is applicable to many different chemical hydride systems that include hydrolysis/hydrides and chemical hydride systems based on hydride/hydroxide reactions. As just one example, the method of the invention is applicable to the regeneration of the simple hydride/hydroxide system LiH+LiOH and LiH+LiOH.$H_2O$, which upon dehydrogenation yield $Li_2O$. However, the method is applicable to other systems, whether simple or complex. The method will be explained in detail using the following examples.

Example 1

Regeneration of LiH and LiOH from $Li_2O$

The hydride/hydroxide chemical hydride system LiH+LiOH generates approximately 6 weight percent hydrogen and the dehydrogenation reaction product is $Li_2O$. Regeneration can be carried out in a molten salt-based electrochemical cell.

Figure 1:
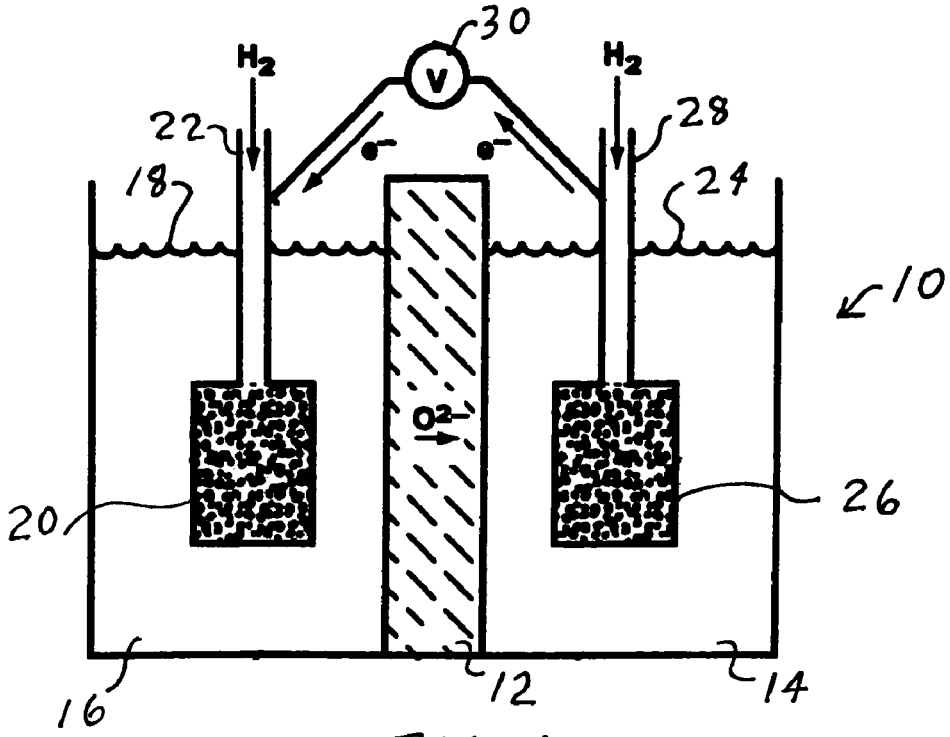
FIG. 1 is one exemplary schematic diagram of a molten salt-based electrochemical cell.

A schematic of this type of molten salt-based electrochemical cell 10 is shown in FIG. 1. An ion conductor, such as an oxygen anion-conducting separator membrane 12, separates an anode side 14 and a cathode side 16 of the cell. An example of the separator membrane is $CeO_2$ doped with approximately 10 atomic percent Gd. Other membranes can be used. A cathode electrolyte 18 in the cathode side 16 comprises a suitable molten salt, such as LiCl or a KCl—LiCl eutectic, in which $Li_2O$ is dissolved. However, other types of electrolytes can be used. For example, up to 10 weight percent $Li_2O$ can be dissolved in LiCl at about 700° C., but other weight percentages/temperatures can be used. A cathode 20 is provided which is a hydrogen electrode constructed from porous Pt or other suitable catalytic, which is electrically conducting and is a chemically stable material. Hydrogen gas is fed to the cathode 20 via a hydrogen feed pipe 22. The anode side 14 of the cell 10 is (initially) identical to the cathode side 16 with $Li_2O$ dissolved in a suitable molten salt 24 with an anode 26 located therein, and connected to a hydrogen feed pipe 28. Upon applying an electrical potential 30 across the cell 10, hydrogen is reduced at the cathode 20 to hydride anions which dissolve into the electrolyte 18. For the $Li_2O+H_2 \rightarrow LiH+LiOH$ reaction, the thermodynamic potential ranges from about 1 to 1.3 Volts at 400 to 1000° C. In practice, the potential ranges up to about 10 V, with about 1 to about 5 V being preferred. To maintain electroneutrality, oxygen anions migrate across the separator membrane 12 from the cathode side 16 to the anode side 14 of the cell 10. At the anode 26, hydrogen is oxidized to protons that react with the dissolved oxygen anions to form hydroxide anions. The cathode reaction may be written as $$H_2+2e^- \rightarrow 2H^-,$$

with an overall cathode side reaction of $$Li_2O+H_2+2e^- \rightarrow 2LiH+O^{2-}.$$

The anode reaction may be written as $$H_2+2O^{2-} \rightarrow 2OH^-+2e^-,$$

with an overall anode side reaction $$Li_2O+H_2+O^{2-} \rightarrow 2LiOH+2e^-.$$

The total cell reaction is thus $$Li_2O+H_2 \rightarrow LiH+LiOH,$$

which is the reverse of the hydride/hydroxide hydrogen generating reaction. Thus, as the cell runs, the cathode electrolyte 18 becomes depleted of $Li_2O$ and enriched in LiH, and the anode electrolyte 24 become depleted of $Li_2O$ and enriched in LiOH. In this way the original hydride/hydroxide chemical hydride mixture is regenerated in a single step without having to first form the pure Li metal. Thermodynamically, the necessary energy input for the electrochemical regeneration reaction is 23 kJ/mol-$H_2$. This single step process results in greatly improved energy efficiency and compares very favorably with conventional method noted above wherein the $Li_2O$ is first converted to Li metal. Again, by way of comparison, two possible chemical reduction methods to generate Li metal from $Li_2O$ are $Li_2O+\frac{1}{2}C \rightarrow 2Li+\frac{1}{2}CO_2$ and $Li_2O+H_2 \rightarrow 2Li+H_2O(g)$. The standard enthalpy for the first reaction is 402 kJ/mol and for the second is 357 kJ/mol, which are much more energy intensive. In addition, depending on the conductivity of the oxygen anion conducting membrane and the melting temperature and solubility characteristics of the electrolyte, the cell could be operated at temperatures from approximately 400 to 800° C. This temperature range is much lower than the temperatures of approximately 1000° C. commonly used for chemical reduction. After reaction, the LiH and LiOH must be separated from the electrolyte and processed to form the hydride/hydroxide chemical hydride mixture.

There are several ways to isolate the LiH and LiOH from electrolytes, with the precise scheme adapted to the electrolyte. However, one general scheme will rely on utilizing solubility differences. For example, for molten LiCl or LiCl/KCl eutectic electrolytes, the LiCl and KCl have very low solubilities in diethyl ether. Thus, after a period of electrolysis, the electrolyte can be cooled, solidified, crushed, and further processed as necessary. Then, the LiCl and KCl can be dissolved in a suitable quantity of a solvent, (e.g., ether) leaving behind LiH or LiOH. The LiCl, KCl, and pure solvent (ether) can be recovered and reused by evaporating and then condensing the ether leaving the salts behind. This method for isolating the LiH and LiOH can be used in the other examples described below for isolating the LiH and LiOH as well as regenerated products having other formulae. Of course, other known extraction methods can be used to isolate the LiH and LiOH.

Example 2

Alternate Cell Design for Regeneration of LiH and LiOH from $Li_2O$

The cell design shown in FIG. 1 relies on dissociation of $Li_2O$ to form Li cations and oxygen anions when dissolving in the cathode and anode electrolytes. Formation of oxygen anions enables ion transport between the electrodes and the oxygen anion conducting separator membrane. If the $Li_2O$ does not dissociate sufficiently upon dissolving in the molten salt electrolyte, an alternate cell design may be necessary.

Figure 2:
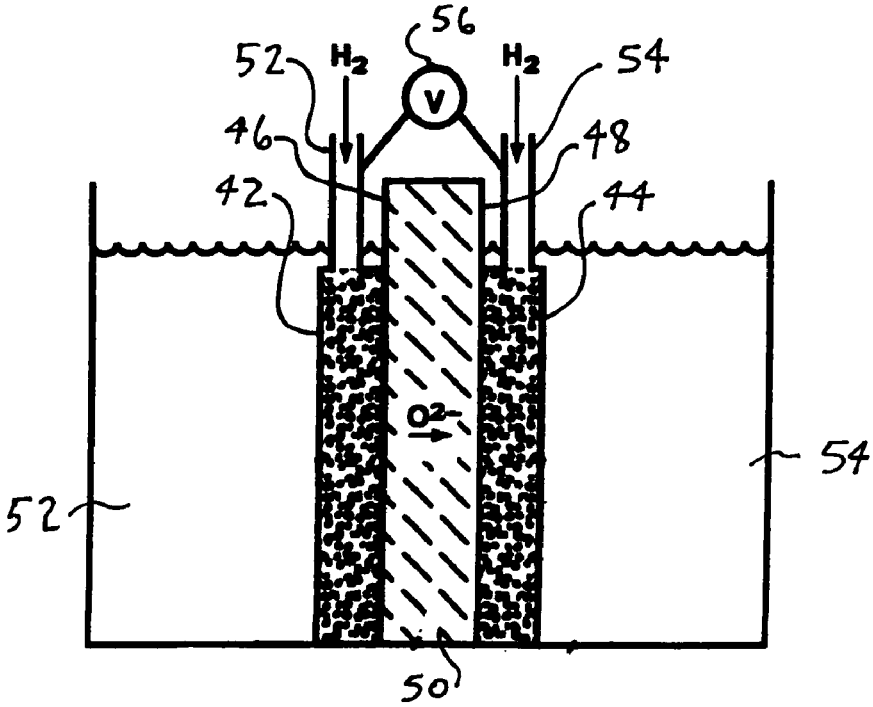
FIG. 2 is another exemplary schematic diagram of a molten salt-based electrochemical cell.

One such exemplary cell design 40 is shown in FIG. 2. In this design, a cathode 42 and an anode 44 are formed directly on the surfaces 46 and 48, respectively, of an ion conducting membrane 50. Hydrogen gas is fed through pipes 52 and 54 to cathode 42 and anode 44, respectively, and an electrical current 56 is applied to drive the reactions. Compartments 52 and 54 containing molten salt no longer need to function as electrolytes but rather only as a reservoir for supplying $Li_2O$ to the cathode 42 and the anode 44. The overall electrode reactions and the total cell reaction remain the same as in Example 1.

This design is similar to a LiOH/LiH solid oxide, fuel cell that is run in reverse by an applied potential.

Example 3

Alternate Process for Regeneration of LiH and LiOH from $Li_2O$

In Example 1, LiH and LiOH are regenerated from $Li_2O$ in a single step. Thermodynamically, the required energy input for this reaction is approximately 23 kJ/mol-$H_2$. An alternate process that in practice may be simpler but likely not as energy efficient, is to separately regenerate LiH and LiOH. For example, LiOH may be regenerated from $Li_2O$ by an exothermic reaction with water. This reaction may be written as $$Li_2O+H_2O \rightarrow 2LiOH.$$

If this reaction is performed, then only the LiH needs to be regenerated electrochemically. This process can use the same electrochemical cells used in Examples 1 and 2 and shown in FIGS. 1 and 2. The difference would be that no $Li_2O$ is added to the anode electrolyte. In this case the overall anode side reaction would be $$H_2+O^2 \rightarrow H_2O(g)+2e^-.$$

The total cell reaction becomes $Li_2O+2H_2 \rightarrow 2LiH+H_2O$ (g)

which requires an energy input of 86 kJ/mol-$H_2$. The energy needed for this reaction is above that required for the single step reaction, namely 86−23=63 kJ/mol-$H_2$, is equal to the heat generated in the exothermic reaction of $Li_2O$ with water. Since it is unlikely that these two reactions could be perfectly coupled energetically, separately regenerating LiH and LiOH will likely be less energy efficient than a single step process.

Example 4

Alternate Anode Design for Hydrogen Oxidation to Water

Figure 3:
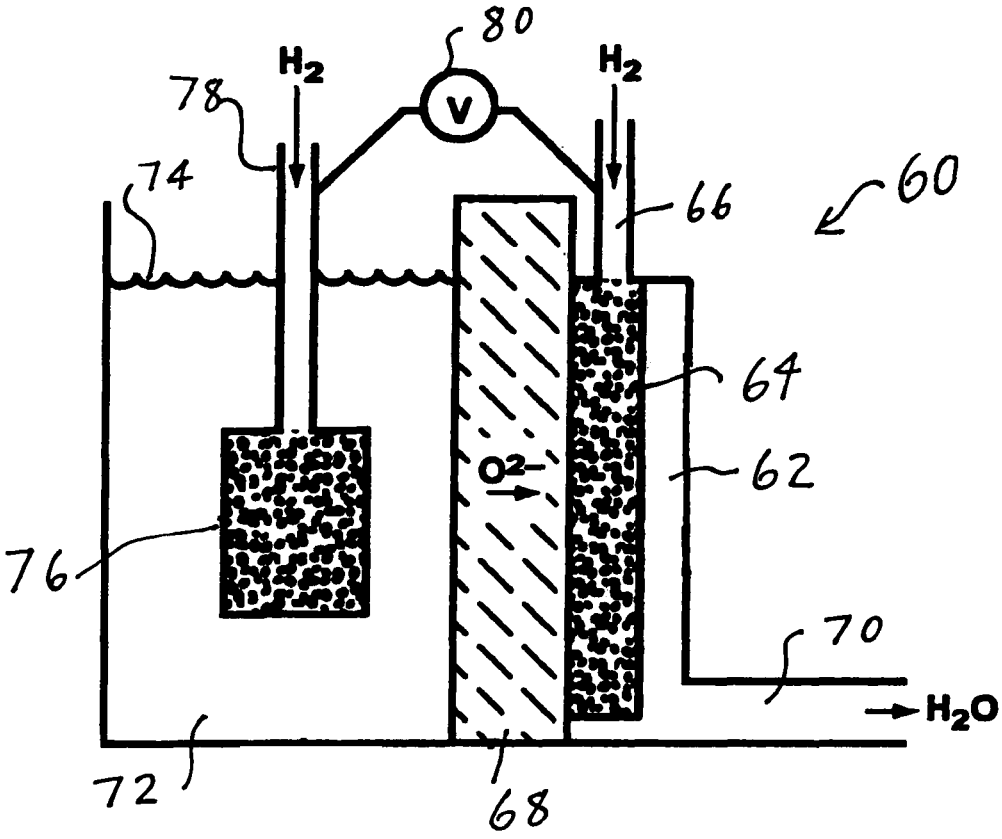
FIG. 3 is a further exemplary schematic diagram of a molten salt-based electrochemical cell.

In Example 3, LiH is produced on the cathode side of the cell and water is produced on the anode side. An alternate cell 60 design is shown in FIG. 3. Since water is produced directly from hydrogen gas and oxygen anions on an anode side 62, unlike the cell designs shown in FIGS. 1 and 2, a molten salt compartment is not necessary. This design is similar to the design shown in FIG. 2 in that an anode 64 feed hydrogen via hydrogen gas pipe 66, with the anode positioned directly against an oxygen anion conducting membrane 68. With this design, the anode side 62 is identical to the anode of a hydrogen/oxygen solid oxide fuel cell. The water generated on the anode side 62 will escape via a tube or vent 70 as hot water or steam. The cathode side 72 has a molten salt electrolyte 74 and a cathode 76 feed by a hydrogen gas pipe 78. An electrical potential 80 is applied to drive the system.

Example 5

Regeneration of $LiBH_4$ and $LiOH.H_2O$ from $Li_3BO_3$ and $Li_4B_2O_5$

The hydride/hydroxide chemical hydride system $3LiBH_4+4LiOH.H_2O$ generates approximately 10 weight percent hydrogen and, therefore, is a very attractive chemical hydride system. Although more complex than regeneration of $Li_2O$ (i.e., Example 1), the $Li_3BO_3+Li_4B_2O_5$ product mixture may also be regenerated using a molten salt-based electrochemical cell. Using the cell design 10 shown in FIG. 1, the $Li_3BO_3+Li_4B_2O_5$ mixture is dissolved in the cathode electrolyte 18. Upon application of an external potential 30, the $BO_3^{3-}$ and $B_2O_5^{4-}$ anions are reduced by hydrogen gas to $BH_4^-$ and $O^{2-}$ at the cathode electrode 20. The $O^{2-}$ anions migrate across the separator membrane 12 from the cathode side 16 to the anode side 14 of the cell. Thus, $LiBH_4$ is formed in the cathode compartment 16. The anode reaction could be formation of LiOH as described in Example 1 or formation of water as described in Examples 3 and 4. Formation of LiOH requires $Li_2O$ as a starting material. Since $Li_2O$ is not produced in the $LiBH_4+LiOH.H_2O$ chemical hydride reaction, additional processing is necessary to produce the required $Li_2O$. Formation of water requires no additional processing. However, as described in Example 2, regeneration to $LiBH_4$ and water will require a larger energy input. Complete reversal of the chemical hydride reaction requires a thermodynamic energy input of approximately 45 kJ/mol-$H_2$. Regeneration to $LiBH_4$ and water requires approximately 85 kJ/mol-$H_2$.

In this example, the cathode reactions are:

$$BO_3^{3-}+2H_2+4e^- \rightarrow BH_4^-+3O^{2-}$$

and $$B_2O_5^{4-}+4H_2+8e^- \rightarrow 2BH_4^-+5O^{2-}.$$

The overall cathode side reaction is $$Li_3BO_3+Li_4B_2O_5+6H_2+12e^- \rightarrow 3LiBH_4+2Li_2O+6O^{2-}.$$

From here, the $LiBH_4$ can be separated from the $Li_2O$ and the electrolyte, as described in Example 1 above, by differences in solubility. $LiBH_4$ is soluble in tetrahydrofuran $[(CH_2)_4O]$ but $Li_2O$, LiCl and KCl are not soluble in tetrahydrofuran. The $Li_2O$ can be isolated from the electrolyte by dissolving the electrolyte in diethyl ether or alcohols, and the $Li_2O$ will not be soluble. The $Li_2O$ can be processed further in two ways depending on the anode reaction. First, the $Li_2O$ can be used in the anode compartment, forming LiOH as in Example 1. Alternatively, the anode reaction could be the formation of water as in Example 3. In this case, the $Li_2O$ can be chemically processed using the water from the anode to form LiOH or $LiOH.H_2O$, again as in Example 3. As already stated in Example 5, this might be simpler, but less energy efficient.

Another point for this example is that depending on the temperature used, a hydrogen overpressure may be necessary to keep the $LiBH_4$ stable. $LiBH_4$ will begin to decompose at about 400° C. A hydrogen overpressure of 100 bar (1500 psia) will extend the temperature to about 700° C. and 350 bar (5000 psia) to about 800° C.

Example 6

Combined Chemical and Electrochemical Process for Regeneration of $LiBH_4$ and $LiOH.H_2O$ from $Li_3BO_3$ and $Li_4B_2O_5$ The exothermic chemical reaction $$LiBO_2+4LiH_4 \rightarrow LiBH_4+Li_2O,$$

has a standard enthalpy change of approximately −6 kJ/mol and can be used to regenerate $LiBH_4$ from $LiBO_2$. A similar reaction, $$Li_3BO_3+Li_4B_2O_5+12LiH \rightarrow 3LiBH_4+8Li_2O$$

can be used to regenerate $LiBH_4$ from the products of the $LiBH_4/LiOH.H_2O$ chemical hydride reaction. The byproduct of this reaction, $8Li_2O$, can be regenerated electrochemically into $12LiH+4LiOH.H_2O$ following Examples 1-4. The regeneration of $LiBH_4$ can also be accomplished using $MgH_2$ or $CaH_2$. The reactions $$LiBO_2+2MgH_2 \rightarrow LiBH_4+2MgO$$

and $$LiBO_2+2CaH_2 \rightarrow LiBH_4+2CaO$$

have standard enthalpy changes of approximately −220 kJ/mol and −88 kJ/mol, respectively. Therefore, using $MgH_2$ or $CaH_2$, instead of LiH, would promote the chemical step of regenerating $LiBH_4$, but would require a larger energy input to regenerate the MgO and CaO byproducts. These byproducts may be regenerated electrochemically using the same processes described for $Li_2O$ in Examples 1-4.

Example 7

Regeneration of Chemical Hydrides Based on Hydrolysis

Chemical hydride systems based on hydrolysis of $LiBH_4$ and $NaBH_4$ have been developed. In particular, a system based on hydrolysis of $NaBH_4$ is being commercialized. The products of $LiBH_4$ and $NaBH_4$ hydrolysis are $LiBO_2$ and $NaBO_2$, respectively. These products can be regenerated electrochemically using the processes described in Examples 3 and 4 and shown schematically in FIGS. 1 to 3. The $LiBO_2$ or $NaBO_2$ is dissolved in a suitable molten salt in the cathode compartment. Upon application of a potential to the cathode hydrogen electrode, electrochemical reduction of BO2− occurs according to the reaction $$BO_2^- + 2H_2 + 4e^- \rightarrow BH_4^- + 2O^{2-}.$$

The oxygen anions generated migrate through the separating membrane to the anode electrode. The anode reaction is $$O^{2-} + H_2 \rightarrow H_2O(g) + 2e^-.$$

The overall reactions are $$LiBO_2 + 4H_2 \rightarrow LiBH_4 + 2H_2O(g)$$

and $$NaBO_2 + 4H_2 \rightarrow NaBH_4 + 2H_2O(g).$$

For $LiBO_2$ the thermodynamic required energy input is approximately 85 kJ/mol-$H_2$. For $NaBO_2$ the thermodynamic required energy input is approximately 75 kJ/mol-$H_2$.

In addition to recycling the products of $LiBH_4$ and $NaBH_4$ hydrolysis as described above, the products of hydrolysis of simple hydrides such as LiH, NaH, or $MgH_2$ could also be recycled using these electrochemical methods. The products are the corresponding hydroxides, i.e. LiOH, NaOH, and $Mg(OH)_2$. These hydroxide products may be recycled by dissolving them in the cathode electrolytes as in all the other examples. However, there are two ways to run the cathode reaction. The first is identical to the other examples in that hydrogen is supplied to the cathode. For LiOH, the cathode reaction is $$H_2 + 2e- \rightarrow 2H^-.$$

This reaction will be followed by a chemical reaction with the dissolved OH— given by $$H^- + OH^- + H_2 + O^{2-}.$$

The $H_2$ produced will be liberated and can be recycled. The overall cathode reaction will be $$LiOH + 2e^- \rightarrow LiH + O^{2-}.$$

Thus, hydrogen is not actually consumed in the overall reaction. However, the reaction may be facilitated kinetically by electrochemically reducing $H_2$. A second embodiment is to not supply hydrogen to the cathode. In this case the cathode reaction is $$OH^- + 2e^- \rightarrow H^- + O^{2-}.$$

Again, the overall cathode reaction is $$LiOH + 2e^- \rightarrow LiH + O^{2-}.$$

In either case the anode reaction is formation of water as in example 3. The complete recycling reaction is $$LiOH + H_2 \rightarrow LiH + H_2O.$$

Once again, as described above, the enthalpy for the direct reaction is much lower than the enthalpy necessary for the conventional recycling process of first generating the metal, followed by reaction of the metal with hydrogen to form the hydride. For example, the enthalpy for the direct reaction $LiOH+H_2 \rightarrow LiH+H_2O$ is 153 kJ/mol.

In contrast, the enthalpy for the reaction to generate Li metal $LiOH+\frac{1}{2}H_2 \rightarrow Li+H_2O$ is 243 kJ/mol.

Reactions for NaOH and $Mg(OH)_2$ are analogous. For NaOH, the enthalpy for the direct reaction $NaOH+H_2 \Theta NaH+H_2O$ is 128 kJ/mol.

The (much higher) enthalpy for the reaction to generate Na metal $NaOH+\frac{1}{2}H_2 \rightarrow Na+H_2O$ is 184 kJ/mol.

Hydrolysis and hydride/hydroxide reactions derive hydrogen through the reaction of materials with at least partial hydride character, i.e., H— as in LiH, $LiBH_4$ etc., with materials with at least partial protonic character, i.e., H+ as in $H_2O$, LiOH, etc. The products are hydrogen and oxides or hydroxides. Given this, the invention herein is a regeneration process that simultaneously regenerates both hydridic and protonic materials—through simultaneous hydrogen reduction and oxidation reactions. If a secondary (or intermediate) hydridic species is used to regenerate the primary species, i.e., as in using $MgH_2$ to regenerate $LiBH_4$ via $LiBO_2+MgH_2 \rightarrow LiBH_4+MgO$, then the simultaneous process is used to regenerate this secondary (or intermediate) species.

Having thus described exemplary embodiments of the present invention, it should be understood by those skilled in the art that the above disclosures are exemplary only and that various other alternatives, adaptations and modifications may be made within the scope of the present invention. The presently disclosed embodiments are to be considered in all respects as illustrative and not restrictive.

What is claimed is:

1. A method for regenerating chemical hydrides from metal oxides, comprising:

providing an electrochemical cell having a cathode side with a molten salt and a cathode, and an anode side with an anode, the cathode side and the anode side being separated by an ion conductor;

placing a metal oxide in the molten salt of the cathode side;

applying an electrical potential to the cathode and the anode;

feeding hydrogen to the cathode to convert the metal oxide to a metal hydride;

feeding hydrogen to the anode; and simultaneously oxidizing hydrogen at the anode and reducing hydrogen at the cathode.

2. The method of claim 1, further comprising transporting an oxygen anion from the cathode to the anode using the ion conductor, wherein the ion conductor is an oxygen anion-conducting membrane.

3. The method of claim 1, further comprising separately regenerating a metal hydroxide from a metal oxide in a chemical reaction by adding water to the metal oxide.

4. The method of claim 3, wherein the regenerating of the metal hydroxide from the metal oxide is energetically linked to the regenerating of the metal hydride from the metal oxide.

5. The method of claim 1, wherein the molten salt in the cathode side comprises an electrolyte.

6. The method of claim 1, wherein the anode side of the electrochemical cell contains a molten salt.

7. The method of claim 6, wherein the molten salt in the anode side of the electrochemical cell has metal oxide added thereto, and the feeding of hydrogen to the anode effectuates conversion of the metal oxide to a metal hydroxide.

8. The method of claim 6, wherein processes occurring at the cathode side and anode side are energetically linked.

9. The method of claim 1, wherein the molten salt comprises a eutectic electrolyte.

10. The method of claim 1, wherein the metal oxide comprises at least one of the group selected from $Li_2O$, $Li_3BO_3$, $Li_4B_2O_5$, $LiBO_2$, MgO, CaO and $NaBO_2$.

11. The method of claim 1, wherein the molten salt is maintained at a temperature of about between 400 to 800° C.

12. The method of claim 1, wherein mixtures of at least two different kinds of metal oxides are added to the cathode side and result in the formation of a metal hydride and another kind of metal oxide, and wherein the metal hydride and the other kind of metal oxide are then separated.

13. A method for regenerating a metal hydroxide to a metal hydride, comprising:

providing an electrochemical cell having a cathode side with a molten salt electrolyte and a cathode, and an anode side with an anode, the cathode side and the anode side being separated by an oxygen anion-conducting membrane;

providing a metal hydroxide in the molten salt electrolyte of the cathode side;

providing a metal hydroxide in the molten salt electrolyte of the anode side and feeding hydrogen to the anode to generate water and free electrons;

applying an electrical potential to the cathode and the anode to convert the metal hydroxide to a metal hydride; and simultaneously oxidizing hydrogen at the anode and reducing hydrogen at the cathode.

14. The method of claim 13, further comprising feeding hydrogen to the cathode.

15. The method of claim 13, wherein the metal hydroxide to be regenerated is selected from the group consisting of LiOH, NaOH and $Mg(OH)_2$, and are regenerated to LiH, NaH and $MgH_2$, respectively.

* * * * *